US006925682B2

(12) United States Patent
Mueller et al.

(10) Patent No.: US 6,925,682 B2
(45) Date of Patent: Aug. 9, 2005

(54) CABINET HINGE WITH ADJUSTING DEVICE

(75) Inventors: Wolfgang Mueller, Lustenau (AT); Markus Albrecht, Lustenau (AT)

(73) Assignee: Grass GmbH, Hochst/Voralberg (AT)

( * ) Notice: Subject to any disclaimer, the term of this patent is extended or adjusted under 35 U.S.C. 154(b) by 126 days.

(21) Appl. No.: 10/379,066

(22) Filed: Mar. 4, 2003

(65) Prior Publication Data

US 2004/0034965 A1 Feb. 26, 2004

(30) Foreign Application Priority Data

Mar. 7, 2002 (DE) ..... 102 10 017

(51) Int. Cl.[7] ..... E05D 7/04

(52) U.S. Cl. ..... 16/242; 16/236; 16/245; 16/246

(58) Field of Search ..... 16/242, 236, 238, 16/245, 241, 246, 335

(56) References Cited

U.S. PATENT DOCUMENTS

| | | | | |
|---|---|---|---|---|
| 1,336,174 A | | 4/1920 | Way | |
| 4,226,591 A | | 10/1980 | Leonard | |
| 4,558,485 A | | 12/1985 | Rock et al. | |
| 4,590,641 A | | 5/1986 | Lautenschlager et al. | |
| 4,654,932 A | | 4/1987 | Rock et al. | |
| 4,680,830 A | * | 7/1987 | Rock et al. | 16/241 |
| 4,691,408 A | | 9/1987 | Rock et al. | |
| 4,976,006 A | | 12/1990 | Lautenschlager | |
| 5,022,116 A | | 6/1991 | Salice | |
| 5,025,530 A | | 6/1991 | Ferrari et al. | |
| 5,036,565 A | | 8/1991 | Salice | |
| 5,056,189 A | | 10/1991 | Brustle et al. | |
| 5,062,180 A | | 11/1991 | Lautenschlager | |
| 5,210,907 A | | 5/1993 | Toyama | |
| 5,245,727 A | | 9/1993 | Sasaki | |
| 5,257,437 A | | 11/1993 | Salice | |
| 5,412,840 A | | 5/1995 | Lautenschlager et al. | |
| 5,511,287 A | | 4/1996 | Lautenschlager et al. | |
| 5,577,297 A | | 11/1996 | Lautenschlager et al. | |
| 5,781,966 A | * | 7/1998 | Ferrari et al. | 16/242 |
| 5,930,866 A | * | 8/1999 | Rupprechter | 16/242 |
| 5,964,011 A | | 10/1999 | Ruston et al. | |
| 6,032,333 A | * | 3/2000 | Brustle | 16/242 |
| 6,061,872 A | | 5/2000 | Albrecht et al. | |
| 6,615,452 B2 | * | 9/2003 | Mueller et al. | 16/242 |
| 6,698,062 B2 | * | 3/2004 | Egger et al. | 16/242 |
| 6,715,180 B2 | * | 4/2004 | Mueller et al. | 16/236 |

FOREIGN PATENT DOCUMENTS

| | | |
|---|---|---|
| DE | 29811793 | 12/1999 |
| DE | 29914473 | 2/2000 |
| EP | 0969173 | 1/2000 |

* cited by examiner

*Primary Examiner*—Anthony Knight
*Assistant Examiner*—Mark Williams
(74) *Attorney, Agent, or Firm*—John M. Harrington; Kilpatrick Stockton LLP

(57) ABSTRACT

The invention concerns a cabinet hinge with an adjusting device that is directly or indirectly on the cabinet side, a single or multi-part mounting plate stored hinge arm, that is connected jointed with a door-side stop part, so that the adjusting device has a side adjusting screw that, by means of which the hinge arm's position is adjustable parallel to the mounting plate to the depth adjustment of the door, and has a depth adjusting screw by which the hinge arm's position is adjustable parallel to the mounting plate to the door's depth adjustment, wo that the depth adjustment screw is held directly or indirectly swiveling and non-shifting on the hinge arm, and has a control component that has at least one eccentric disk that has at least one partially cone-type adjusting surface that is supported on contact surfaces of the mounting plate and by turning the side adjusting screw, a side adjustment and, at the same time, a shifting of the hinge arm activates somewhat in the direction of its longitudinal axis relative to the mounting plate and with it a correction of the door's depth adjustment, so that the reveal/gap between the door and the cabinet side wall remain basically unchanged after the resulting side adjustment.

12 Claims, 2 Drawing Sheets

CABINET HINGE WITH ADJUSTING DEVICE

FIELD OF INVENTION

The invention concerns a cabinet hinge with an adjusting device that connects directly or indirectly on a cabinet-side, a single- or multi-component mounting plate stored hinge arm, according to the characterizing or introductory clause of the independent and individual patent claims.

BACKGROUND OF THE INVENTION

Generally, cabinet hinges have various adjustment possibilities.

So, an adjustment of the hinge arm's position relative to the mounting plate in the direction of the cabinet reveal/gap (that is, a side adjustment of the cabinet door) is possible. This adjustment is achieved by the so-called side adjustment screw that is stored in the hinge arm's thread and is held by its head in a recess of the mounting plate. Depending on how the screw is turned, the hinge arm is lifted more or less from the mounting plate, resulting in a side or lateral adjustment of the cabinet door.

Another possible adjustment is the hinge arm's depth adjustment, through which the cabinet door's distance is adjusted to the front of the cabinet. The depth adjustment can generally be accomplished by a locking screw, by which the hinge arm is fastened on the mounting plate. The locking screw projects through a slot in the hinge arm; the depth can be adjusted by sliding the screw along the slot; the length of the slot determines the depth adjustment.

A cabinet hinge of the type named above is made known by DE 298 11 793 U1.

The known adjusting devices have, however, considerable disadvantages.

With reference to the side adjustment of the doors, the hinge arm swings around an imaginary axis when the side adjusting screw is turned, so that the adjustment movement results along an arc. Not only is the side position of the door adjusted, but also the door's depth position is unintentionally adjusted, changing the door's distance from the front edge of the cabinet.

The problem with the depth adjustment is that the depth adjusting screw must be loosened in order to allow it to slide along the slot. A slight adjustment is not possible in this manner.

A hinge that has the equalizing function of the side adjustment is described in DE 299 14 473 U1. At least one pivoting lever swings or rotates when the side adjusting screw is turned or swiveled and is supported directly or indirectly on the hinge arm, so that when the reveal adjusting screw is turned, the hinge arm is guided by at least one pivot lever that is parallel to the baseplate. The design shown here appears, however, to be very expensive and complex to produce.

SUMMARY OF THE INVENTION

The task of the invention is to propose a cabinet hinge that has improved adjustment possibilities without incurring excessive design and manufacturing expenditures.

The solution of this task results from the features and characteristics of the independent and individual patent claims.

A fundamental characteristic is the depth adjusting screw that is held directly or indirectly, swiveling or fixed on the hinge arm and a control component that has at least one eccentric disk or spiral-shaped or helix-shaped disk with at least one partially cone-type or concave or convex adjusting surface, which is supported on a corresponding contact surface of the mounting plate, so that when the side adjusting screw is turned it results in a side adjustment, and the hinge arm slides parallel in relation to the mounting plate. This causes a correction of the door's depth adjustment so that the gap/reveal between the door and the cabinet side wall is basically unchanged after the resulting side adjustment.

The depth adjusting screw is therefore, designed as a control component that has surfaces (facet-type) with sloping angles, which are fixed between two stationary stops of the adjusting plate. The depth adjusting screw is held swiveling and axially unmovable.

Advantages:

1. Simple side adjusting screws as with traditional hinges;
2. Depth adjusting screw with a double function;
3. Only a single screw adjusts the gap/reveal and the gap/reveal's correction with a side adjustment.

The Double of the Depth Adjusting Screw:

a) By turning the depth adjusting screw, the gap/reveal width is preset by the control component and its slanted surfaces (for example, the pre-selected gap/reveal width is 2.5 mm).

b) By turning the side adjusting screw to laterally adjust the door, the slanted surfaces of the depth adjusting screw glide along the stationary stops and, thereby, move the hinge arm around the necessary amount to correct the gap/reveal. The preset gap/reveal width (in our example, 2.5 mm) remains.

The cone-type adjusting surface of the depth adjusting screw is preferably designed truncated and/or tapered and extends not only over the full range of the depth adjusting screw of 360° (but also only about, for example 270), so the stop surfaces can be formed on the open front sides to limit the rotation angle in order to work together with the corresponding stop surfaces on the adjusting plate.

In addition, variations other than the truncated cone form of the adjusting surfaces are possible; whereby, only at least an off-center swiveling eccentric disk for gliding the bearing surface of the adjusting plate over the range of the adjusting surface is necessary as a first depth adjustment.

Further, at least one slanted surface on the eccentric disk for the radial and simultaneous axial sliding of the contact surfaces of the adjusting plate in reference to the rotation axis depth adjusting screw is necessary. So under these conditions, adjusting surfaces can also be used, which, instead of being formed like a truncated cone, can be diagonal, slanted, concave or convex, or, instead of eccentric, can be spiral-shaped or helix-shaped.

Preferably, however, two rotationally symmetrical eccentric disks with truncated cone-shaped adjusting surfaces, which lie axially one on the other, have symmetrical axes that are distanced somewhat parallel to the axis of rotation of the depth adjusting screw and to itself, so that as the truncated cone-shaped adjusting surfaces taper, they move in opposite directions from a common basis.

The adjusting plate has an opening in which area the contact surfaces are formed for the cooperating gliding on the adjusting surfaces of the eccentric disks.

A first contact surface is formed, preferably, on the edge of the opening itself and the second contact surface is formed by a nose set off by an opening; whereby, the contact surfaces that lie one on the other result in two levels for the cooperating sliding on the adjusting surfaces of the eccentric disks. There, the nose is preferably stamped one-piece out of the adjusting plate and bent so that the adjusting plate is, for example, clipped on the baseplate as a separate part.

Subsequently, an embodiment of the invention is more closely described on the basis of illustrated representations. Further characteristics, advantages and uses of the invention result from the drawings and their descriptions.

DETAILED DESCRIPTION

Figures 1, 4:
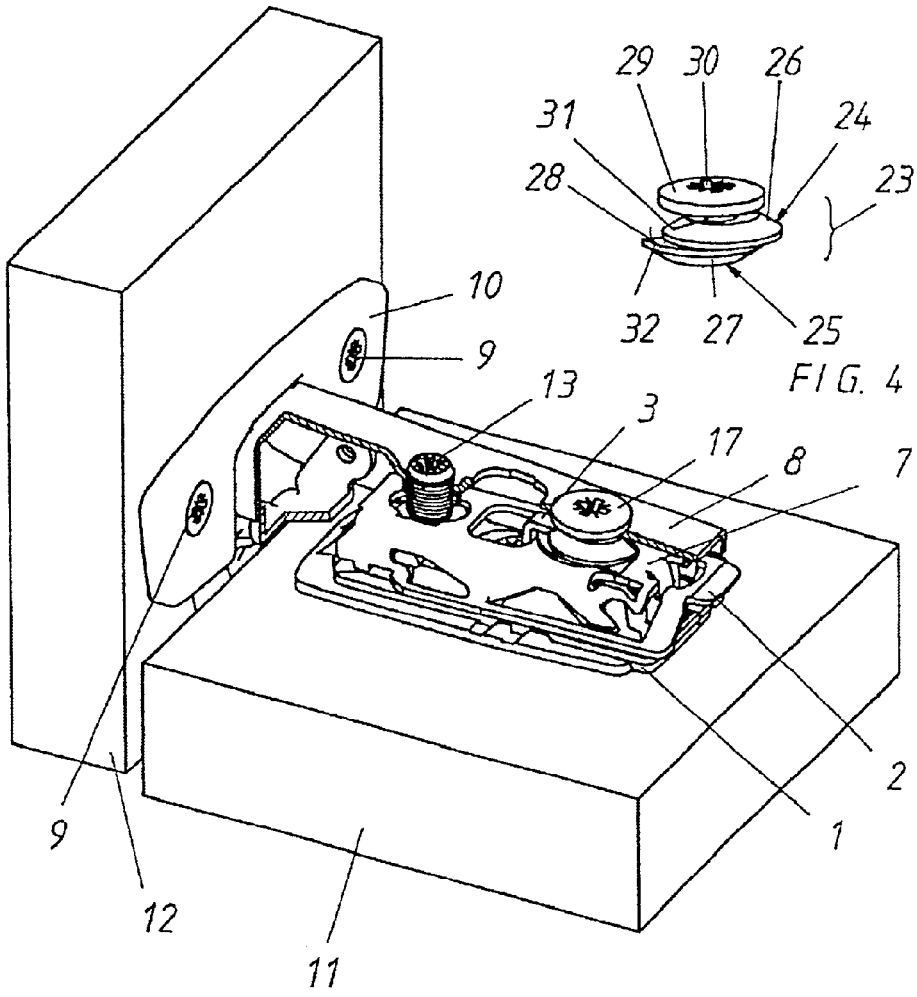
FIG. 1: a perspective view of the invention-related cabinet hinge in the mounted position with a partial longitudinal section through the hinge arm.
FIG. 4: a side adjusting screw according to the invention.

The cabinet hinge includes a mounting plate, consisting of a baseplate (1) and an adjusting plate (2); whereby, the baseplate (1) is fastened on the side wall of the cabinet (11). The adjusting plate (2) can be connected lockable and releasable with the baseplate (1). The hinge arm (8) is fastened on the adjusting plate (2), which is connected articulated with a door-side stop component (for example, a hinge cup [10]) that is fixed into the cabinet door (12) by screws (9). A conventional side adjusting screw (13) is provided to adjust the cabinet door (12) laterally (that is, to adjust the hinge arm [8] in the direction to the assembly level and/or baseplate [1]).

The depth adjustment (that is, the adjustment of the hinge arm [8] parallel to the baseplate [1]) takes place by means of a depth adjusting screw (17), which, according to the state of the art, does not have thread, but instead is inserted by its screw neck into an opening in the hinge arm (8) and is held there in such a manner that it can be turned, but is not movable. Additionally, the depth adjusting screw (17) engages with its control component (23), which has an axial upper (24) and a lower eccentric disk (25), into a recess (6) in the adjusting plate (2). The axial upper eccentric disk (24) lies here with its angled, facet-shaped adjusting surface (26) on an L-shaped nose (3) or is fastened to it. The nose (3) is formed one-piece out of the adjusting plate (2). Furthermore, the lower eccentric disk (25) lies with its angled, facet-shaped adjusting surface (27) on the inner edge of the adjusting plate's (2) recess (6). The nose (3) and the inner edge of the recess (6) do not lie here on the same level; whereby, the nose (3) projects out of the adjusting plate's (2) upper surface towards the hinge arm (8).

Both adjusting surfaces (26 and 27) are made somewhat truncated cone-shaped and run axially to the longitudinal axis of the depth adjusting screw (17) mirror-inverted tapering to a point, so that the upper adjusting surface (26) runs to the neck (31) and the head (29) to the screw (17), but the lower adjusting surface (27) runs away from the neck (31) and head (29). Also, the contact surface (3*a*) of the nose (3) and the contact surface (7*a*) of the edge (7) of the opening (6) of the adjusting plate (2) are suitably designed conical, to work together with the adjusting surfaces (26 and 27), so that favorable gliding surfaces allow for sliding on one another and almost no material abrasion or wearing occurs.

Besides, both symmetrical axes of the eccentric disks (24,25) and their adjusting surfaces (26,27) are arranged radial to each other and to the longitudinal axis of the screw (17), so that eccentricity exists in each case. Both eccentric disks (24,25) are formed somewhat eccentrically to the longitudinal axis of the screw (17) so that the adjusting surfaces (26,27) move radial when the screw (17) is turned by engaging a tool in the opening (30), resulting in the depth adjustment of the door (12).

The stop surface (28) of the screw (17) prevents the screw (17) from being overturned by the location on the adjusting plate (2) in the maximum position. Likewise, instead of this or in addition to this, the stop surface can be located on the upper eccentric disk (24). Also, an additional stop surface to prevent the screw (17) from being overturned can be provided in the opposite direction so that both directions of rotation are secured.

The screw (17) is either, at least, partially formed between the neck (31) and the eccentric disks (24,25) so that an insertion into the hinge arm recess is possible, or that this opening is designed as a slot and/or elongated hole is somewhat longer than the diameter of the head (29) of the screw (17).

In a certain relative position of the screw (17) to the opening (6) in the adjusting plate (2), the screw (17) can be threaded in there, so that then the contact surface (3*a*) of the nose (3) lies on the surface (26) and the contact surface (7*a*) of the opening edge (7) lies on the surface (27), as well as the underside of the nose (3) that lies on the level bearing surface (32) between the eccentric disks (24,25), so that the control component (23) is easily clamped in the adjusting plate (2).

If the depth adjusting screw (17) is turned by overcoming the clamping resistance, then the hinge (8) can be shifted towards arrow direction (22), until the gap/reveal S has attained the desired amount, which, for example, can be pre-set to 2.5 mm. Thus, an easy, precise and sensitive depth adjustment can be attained.

Figure 2:
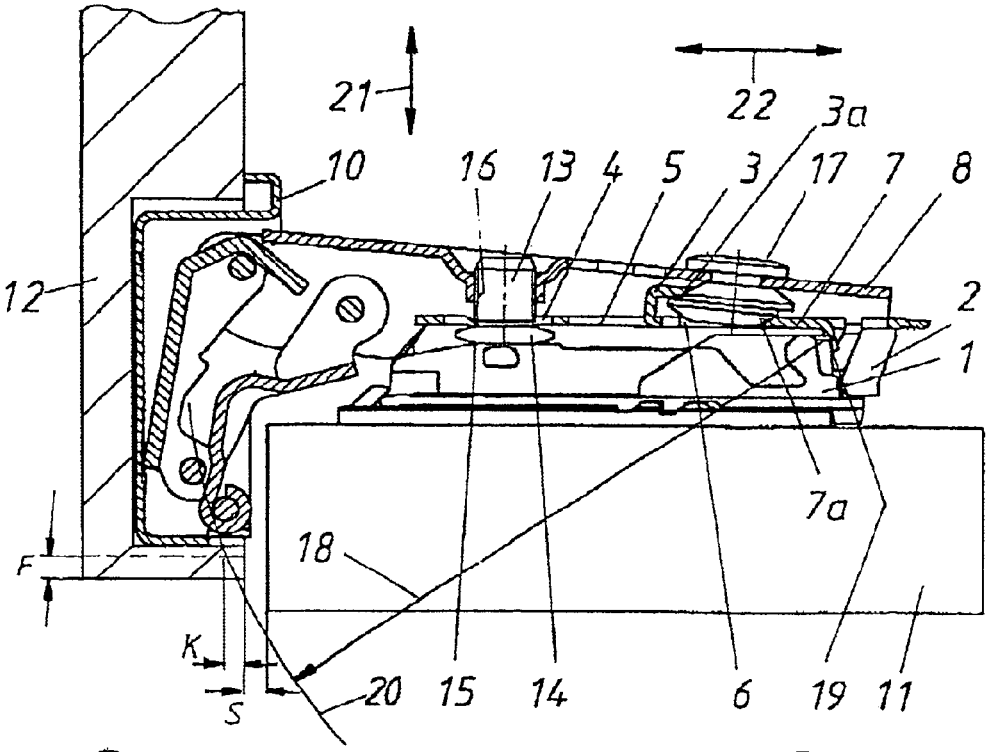
FIG. 2: a longitudinal section through the invention-related cabinet hinge in a first position with maximum side adjustment.
Figure 3:
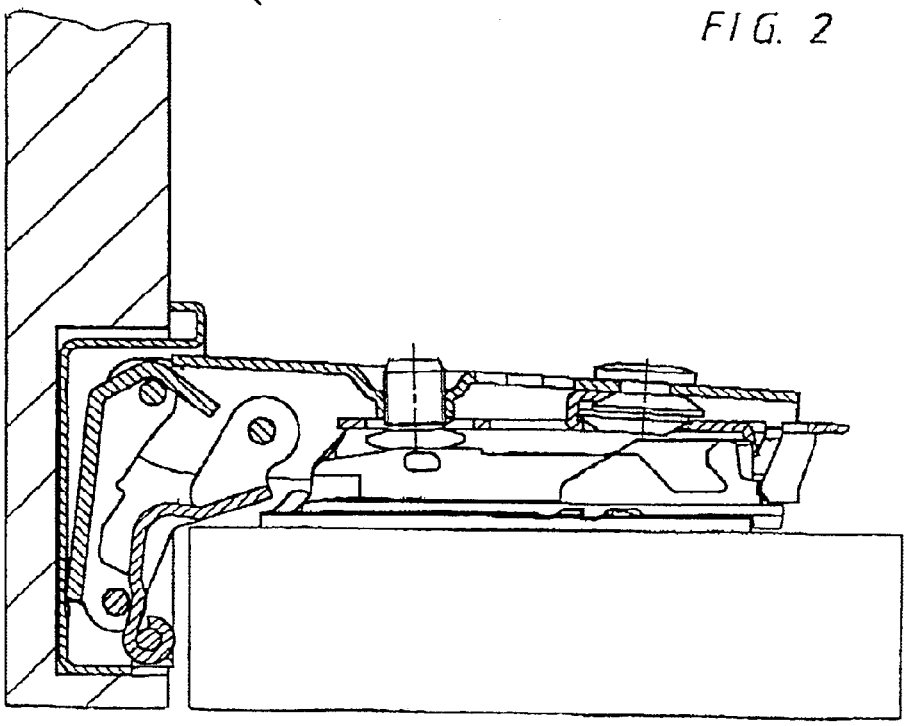
FIG. 3: a longitudinal section through the invention-related in a second position with minimum side adjustment.

The side adjusting screw (13) is held with its thread (16) in a threaded bore hole in the hinge arm (8) and is supported with its screw head (14) on a corresponding contact surface (15) of the adjusting plate (2). When the side adjusting screw (13) is turned, the hinge arm (8) is then adjusted in arrow direction (21) so that the door (12), for example, swings from the position shown in FIG. 1 to the position shown in FIG. 2 and changes the reveal/gap F.

Because now, however, during the side adjustment the hinge arm (8) does not operate with a pure lifting motion in arrow direction (21), but instead, a swinging motion from a circular motion around an imaginary axis with fulcrum (19) results in an adjustment movement along an arc (20) with the radius (18). Thus, not only is there an adjustment of reveal/gap width F, but simultaneously, there is an undesirable change of the reveal/gap S around the amount K.

This undesired depth adjustment movement is counteracted by the invention because the depth adjusting screw (17) has a control component (23), that compensates by changing the reveal/gap S around the amount K by turning the side adjustment screw (13).

Now if the side adjustment screw (13) is turned right, the hinge arm (8) raises up due to the thread (16) and, at the same time, the adjusting surfaces (26,27) slide on the respective contact surfaces of the nose (3) and the opening edge (7) of the adjusting plate (2), which are connected by the baseplate (1) with the cabinet (11). This gliding of the adjusting surfaces (26,27) on the corresponding contact surfaces of the nose (3) and the opening edge (7) of the adjusting plate (2) is then also, when the side adjusting screw (13) is turned and then the connected hinge (8) swivels and the door (12), the reveal/gap S is automatically changed around the negative amount K, so that the hinge (8) and with it the door (12), is moved in the opposite direction (22).

The hinge arm (8) is moved in direction (22) around an amount K in the depth by the turning of the side adjustment screw (13) and the swiveling of the hinge arm (8) around the fulcrum (19), so that the reveal/gap S changes. At the same time, however, because of the automatic depth compensation of the depth adjustment screw (17), the hinge arm (8) moves against the set direction (22) around preferably the same amount K (however negative), so that the depth adjustment screw (17) by the control component (23) in the most favorable case results in a compensation of the depth adjustment around the amount K and the reveal/gap S remains constant at the preset value (for example, 2.5 mm).

The depth adjustment has a special depth adjustment screw (17) that is shown more closely in FIG. 4. The depth adjustment screw (17) includes two eccentric disks (24 & 25) that lie on one another, that work together with the corresponding contact surfaces in the adjusting plate (2). The adjusting plate (2) has a special opening (6) with an opening edge (7) and an offset nose (3) from the adjusting plate (2), which form contact surfaces that work together with the upper and lower eccentric disks (24,25).

Thus, the core of the invention lies in the fact that a compensation device is used for adjusting the side adjusting screw (13). In addition to the desired side adjustment in arrow direction (21) around the amount F, there is also the unwanted change of the reveal/gap width in the depth direction in arrow direction (22) around the amount K between the door (12) and the cabinet (11). The compensation device consists of a control component (23) with two eccentric disks (24,25) that have two gliding surfaces (26, 27) connected slanted against each other, fixed with the depth adjusting screw (17). These gliding surfaces (26,27), which are placed against each other, lie on corresponding, stationary surfaces (3*a*,7*a*) of the adjusting plate (2).

When the side adjusting screw (13) is operated, the control component slides along the gliding surfaces (26,27) in the adjusting plate (2) in the hinge's longitudinal direction. When the side adjusting screw (13) is operated, the resulting change around the amount K of the reveal/gap S between the door (12) and the cabinet (11) is equalized and/or balanced by the compensation movement.

It is presupposed here that a given reveal/gap dimension S can already be set with the invention-related depth adjusting screw (17), which can then be changed in an unwanted way by operating the side adjusting screw (13). This is where the invention comes in—when the side adjusting screw (13) is operated, because of the depth adjusting screw's (17) connection with the control component, a compensation or equalization takes care of the unwanted change of the reveal/gap width in the depth direction around the amount K.

| Drawing Legend | |
|---|---|
| 1. | Baseplate |
| 2. | Adjusting plate |
| 3. | Nose; 3a Contact surface |
| 4. | Bearing for 13 |
| 5. | Opening |

-continued

| Drawing Legend | |
|---|---|
| 6. | Opening for 17 |
| 7. | Edge of 6; 7a Contact surface |
| 8. | Hinge arm |
| 9. | Screw |
| 10. | Hinge cup |
| 11. | Cabinet side wall |
| 12. | Cabinet door |
| 13. | Side adjusting screw |
| 14. | Screw head |
| 15. | Contact surface |
| 16. | Thread |
| 17. | Depth adjusting screw |
| 18. | Radius |
| 19. | Fulcrum |
| 20. | Arc |
| 21. | Arrow direction |
| 22. | Arrow direction |
| 23. | Control component |
| 24. | Upper eccentric disk of 23 |
| 25. | Lower eccentric disk of 23 |
| 26. | Angled adjusting surface of 24 |
| 27. | Angled adjusting surface of 25 |
| 28. | Stop surface |
| 29. | Screw head of 17 |
| 30. | Opening for tool in 29 |
| 31. | Neck of 17 |
| 32. | Level bearing surface of 25 |
| S | Reveal/gap width in depth direction |
| K | Compensation amount of S |
| F | Reveal/gap width in side direction |

What is claimed is:

1. Cabinet hinge with an adjusting device that is mountable on a cabinet side, comprising:

a mounting plate;

a hinge arm that is supported on the mounting plate and fastened in a jointed manner with a door-side stop component mountable to a door;

a side adjusting screw for selectively adjusting a position of the hinge arm relative to the mounting plate in a direction substantially perpendicular to a longitudinal axis of the mounting plate, resulting in a corresponding side adjustment of the door;

a depth adjusting screw received in the hinge arm for selectively adjusting a position of the hinge arm relative to the mounting plate in a direction that is parallel to the longitudinal axis of the mounting plate, resulting in a corresponding depth adjustment of the door, wherein the depth adjusting screw is held on the hinge arm rotatable about an axis of rotation of the depth adjusting screw but radially and axially stationary relative to the hinge arm and has a control component that has at least one eccentric disk with at least one truncated cone-shaped, convex adjusting surface that is supported on a corresponding contact surface of the mounting plate; and wherein turning the side adjusting screw effects said side adjustment of the door by an amount (F) and, at the same time, effects an incremental shift of the hinge arm in a direction of a longitudinal axis of the hinge arm relative to the mounting plate, thereby causing a correction of said depth adjustment of the door by an amount (K) so that a reveal/gap width (S) between the door and the cabinet side wall remains essentially unchanged after the effected side adjustment of the door.

2. Cabinet hinge, according to claim 1, wherein the mounting plate further comprises a baseplate and an adjusting plate.

3. Cabinet hinge, according to claim 1, wherein said at least one adjusting surface extends less than 360° about a central axis of the eccentric disc.

4. Cabinet hinge, according to claim 3, wherein said central axis of said at least one adjusting surface is distanced from and extends parallel to the axis of rotation of the depth adjusting screw.

5. Cabinet hinge, according to claim 4, further comprising a second eccentric disk lying adjacent said at least one eccentric disk, which eccentric disks have mirror-image inverted truncated cone-shaped adjusting surfaces.

6. Cabinet hinge, according to claim 5, wherein each of the eccentric disks has a central axis disposed substantially parallel to and distanced from the axis of rotation of the depth adjustment screw and substantially parallel to one another.

7. Cabinet hinge, according to claim 6, wherein a lower one of the eccentric disks is spaced apart from a head of the depth adjusting screw and tapers to a free end of the depth adjustment screw and an upper one of the eccentric disks is situated between the lower one of the eccentric disks and the screw head and tapers toward the screw head.

8. Cabinet hinge, according to claim 7, wherein the adjusting plate has an opening in which the corresponding contact surface is formed on which said at least one adjusting surface is supported.

9. Cabinet hinge, according to claim 8, where the corresponding contact surface formed in the opening in the adjusting plate further comprises a first contact surface on an edge of the opening and a nose set off from the opening with a second contact surface, so that there are two levels of contact surfaces formed that lie one on the other to cooperatively engage the at least one adjusting surface.

10. Cabinet hinge, according to claim 9, wherein the depth adjusting screw has stop surfaces to limit rotation of the depth adjusting screw.

11. Cabinet hinge, according to claim 10, wherein the stop surfaces on the depth adjusting screw cooperate with corresponding stop surfaces on the adjusting plate.

12. Cabinet hinge, according to, claim 11, wherein the depth adjusting screw has a rotation-symmetrical neck, which engages through a recess of the hinge arm and is inserted there so it can be turned but not shifted relative to the hinge arm.

* * * * *